US006637927B2

(12) United States Patent
Lu et al.

(10) Patent No.: US 6,637,927 B2
(45) **Date of Patent: *Oct. 28, 2003**

(54) METHOD AND APPARATUS FOR MAGNETICALLY STIRRING A THIXOTROPIC METAL SLURRY

(75) Inventors: Jian Lu, Jackson, TN (US); Shaupoh Wang, Jackson, TN (US); Samuel M. D. Norville, Jackson, TN (US)

(73) Assignee: Innovative Products Group, LLC, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/166,511

(22) Filed: Jun. 10, 2002

(65) Prior Publication Data

US 2002/0186616 A1 Dec. 12, 2002

Related U.S. Application Data

(63) Continuation of application No. 09/585,060, filed on Jun. 1, 2000, now Pat. No. 6,402,367.

(51) Int. Cl.[7] ..... B22D 27/02; B01F 13/08

(52) U.S. Cl. ..... 366/273; 366/147; 164/504

(58) Field of Search ..... 366/273, 274, 366/142, 144, 147, 601; 164/468, 504

(56) References Cited

U.S. PATENT DOCUMENTS

| | | | | |
|---|---|---|---|---|
| 972,429 | A | 10/1910 | Baird | 266/241 |
| 1,506,281 | A | 8/1924 | Baily | 266/280 |
| 1,776,355 | A | 9/1930 | Eppensteiner | 266/280 |
| 3,472,502 | A | 10/1969 | Schott | 266/27 |
| 3,791,015 | A | 2/1974 | Lucenti | 29/401 |
| 3,840,364 | A | 10/1974 | Flemings et al. | 75/63 |
| 3,842,895 | A | 10/1974 | Mehrabian et al. | 164/49 |
| 3,882,923 | A | 5/1975 | Alberny et al. | |
| 3,902,544 | A | 9/1975 | Flemings et al. | 164/71 |
| 3,948,650 | A | 4/1976 | Flemings et al. | 75/135 |
| 3,951,651 | A | 4/1976 | Mehrabian et al. | 75/135 |
| 3,981,351 | A | 9/1976 | Dompass | 164/283 |
| 3,995,678 | A | 12/1976 | Zavaras et al. | |
| 4,088,295 | A | 5/1978 | Medovar et al. | 249/79 |
| 4,089,680 | A | 5/1978 | Flemings et al. | 75/129 |
| 4,108,643 | A | 8/1978 | Flemings et al. | 75/135 |
| 4,125,364 | A | 11/1978 | Stephens | 432/145 |
| 4,174,214 | A | 11/1979 | Bennett et al. | 75/168 R |

(List continued on next page.)

FOREIGN PATENT DOCUMENTS

| | | |
|---|---|---|
| EP | 0 701 002 A1 | 3/1996 |
| EP | 0710 515 A1 | 5/1996 |
| EP | 0 745 694 A1 | 12/1996 |

(List continued on next page.)

OTHER PUBLICATIONS

"Semisolid Metal Process Eliminates Preformed Billets", by Samuel D. Norville, *Die Casting Management*, Mar. 1998, pp. 31–33.

U.S. patent application Ser. No. 09/250,824, filed Feb. 17, 1999, Norville et al.

*Primary Examiner*—Tony G. Soohoo

(74) *Attorney, Agent, or Firm*—Woodard, Emhardt, Moriarty, McNett & Henry LLP

(57) ABSTRACT

A method and apparatus for stirring a molten thixotropic aluminum alloy comprising a first solid particulate phase suspended in a second liquid phase so as to maintain its thixotropic character by degenerating forming dendritic particles into spheroidal particles while simultaneously equilibrating the melt temperature by quickly transferring heat between the melt and its surroundings. The melt is stirred by a magnetomotive force field generated by a stacked stator assembly. The stacked stator assembly includes a stator ring adapted to generate a linear/longitudinal magnetic field positioned between two stator rings adapted to generate a rotational magnetic field. The stacked stator rings generate a substantially spiral magnetomotive mixing force and define a substantially cylindrical mixing region therein.

20 Claims, 11 Drawing Sheets

U.S. PATENT DOCUMENTS

| | | | | |
|---|---|---|---|---|
| 4,229,210 | A | 10/1980 | Winter et al. | 75/10 |
| 4,321,958 | A | 3/1982 | Delassus | 164/504 |
| 4,345,637 | A | 8/1982 | Flemings et al. | 164/113 |
| 4,415,374 | A | 11/1983 | Young et al. | 148/2 |
| 4,434,837 | A | 3/1984 | Winter et al. | 164/468 |
| 4,450,893 | A | 5/1984 | Winter et al. | 164/468 |
| 4,457,354 | A | 7/1984 | Dantzig et al. | 164/468 |
| 4,457,355 | A | 7/1984 | Winter et al. | 164/468 |
| 4,465,118 | A | 8/1984 | Dantzig et al. | 164/452 |
| 4,482,012 | A | 11/1984 | Young et al. | 165/146 |
| 4,494,461 | A | 1/1985 | Pryor et al. | 102/464 |
| 4,523,624 | A | 6/1985 | Dantzig et al. | 164/454 |
| 4,524,820 | A | 6/1985 | Gullotti et al. | 164/476 |
| 4,530,404 | A | 7/1985 | Vives | 164/467 |
| 4,555,272 | A | 11/1985 | Ashok et al. | 148/3 |
| 4,565,241 | A | 1/1986 | Young | 164/499 |
| 4,569,218 | A | 2/1986 | Baker et al. | 72/342 |
| 4,607,682 | A | 8/1986 | Dantzig et al. | 164/418 |
| 4,614,225 | A | 9/1986 | Ernst et al. | 164/504 |
| RE32,529 | E | 10/1987 | Vives | 164/467 |
| 4,709,746 | A | 12/1987 | Young et al. | 164/485 |
| 4,712,413 | A | 12/1987 | Koch | 72/361 |
| 4,729,422 | A | 3/1988 | Ernst et al. | 164/468 |
| 4,774,992 | A | 10/1988 | George | 164/122.1 |
| 4,838,988 | A | 6/1989 | Lang et al. | 156/624 |
| 4,877,079 | A | 10/1989 | Long et al. | 164/468 |
| 5,098,487 | A | 3/1992 | Brauer et al. | 148/432 |
| 5,135,564 | A | 8/1992 | Fujikawa et al. | 75/10.14 |
| 5,219,018 | A | 6/1993 | Meyer | 164/468 |
| 5,247,988 | A | 9/1993 | Kurzinski | 164/485 |
| 5,332,200 | A | 7/1994 | Gorin et al. | 266/280 |
| 5,425,048 | A | 6/1995 | Heine et al. | 373/151 |
| 5,501,266 | A | 3/1996 | Wang et al. | 164/113 |
| 5,529,391 | A | 6/1996 | Kindman et al. | 366/145 |
| 5,549,732 | A | 8/1996 | Dube et al. | 75/331 |
| 5,585,067 | A | 12/1996 | Leroy et al. | 420/554 |
| 5,630,466 | A | 5/1997 | Garat et al. | 164/457 |
| 5,701,942 | A | 12/1997 | Adachi et al. | 164/71.1 |
| 5,899,567 | A | 5/1999 | Morris, Jr. | 366/274 |
| 5,900,080 | A | 5/1999 | Baldi et al. | 148/550 |
| 5,925,199 | A | 7/1999 | Shiina et al. | 148/538 |
| 6,003,590 | A | 12/1999 | Pavlicevic et al. | 164/468 |
| 6,021,842 | A | 2/2000 | Bulhoff et al. | 164/504 |
| 6,065,526 | A | 5/2000 | Kono | 164/113 |
| 6,165,411 | A | 12/2000 | Adachi et al. | 266/135 |
| 6,402,367 | B1 * | 6/2002 | Lu et al. | 366/273 |

FOREIGN PATENT DOCUMENTS

| | | |
|---|---|---|
| EP | 0 841 406 A1 | 5/1998 |
| EP | 0 903 193 A1 | 3/1999 |
| JP | 61-67555 | 4/1986 |
| JP | 1-192446 | 8/1989 |
| JP | 6-28939 | 2/1994 |
| WO | WO95/19237 | 7/1995 |
| WO | WO98/23403 | 6/1998 |
| WO | WO 98/30346 | 7/1998 |
| WO | WO99/50007 | 10/1999 |
| WO | WO00/05015 | 2/2000 |

* cited by examiner

METHOD AND APPARATUS FOR MAGNETICALLY STIRRING A THIXOTROPIC METAL SLURRY

The present Application is a continuation of U.S. patent application Ser. No. 09/585,060, filed Jun. 1, 2000 now U.S. Pat. No. 6,492,367, the contents of which are hereby incorporated by reference.

TECHNICAL FIELD OF THE INVENTION

The present invention relates generally to metallurgy, and, more particularly, to a method and apparatus for controlling the microstructural properties of a molded metal piece by efficiently controlling the temperature and viscosity of a thixotropic precursor metal melt through precisely controlled magnetomotive agitation.

BACKGROUND OF THE INVENTION

The present invention relates in general to an apparatus which is constructed and arranged for producing an "on-demand" semi-solid material for use in a casting process. Included as part of the overall apparatus are various stations which have the requisite components and structural arrangements which are to be used as part of the process. The method of producing the on-demand semi-solid material, using the disclosed apparatus, is included as part of the present invention.

More specifically, the present invention incorporates electromagnetic stirring techniques and apparata to facilitate the production of the semi-solid material within a comparatively short cycle time. As used herein, the concept of "on-demand" means that the semi-solid material goes directly to the casting step from the vessel where the material is produced. The semi-solid material is typically referred to as a "slurry" and the slug which is produced as a "single shot" is also referred to as a billet.

It is well known that semi-solid metal slurry can be used to produce products with high strength, leak tight and near net shape. However, the viscosity of semi-solid metal is very sensitive to the slurry's temperature or the corresponding solid fraction. In order to obtain good fluidity at high solid fraction, the primary solid phase of the semi-solid metal should be nearly spherical.

In general, semi-solid processing can be divided into two categories; thixocasting and rheocasting. In thixocasting, the microstructure of the solidifying alloy is modified from dendritic to discrete degenerated dendrite before the alloy is cast into solid feedstock, which will then be re-melted to a semi-solid state and cast into a mold to make the desired part. In rheocasting, liquid metal is cooled to a semi-solid state while its microstructure is modified. The slurry is then formed or cast into a mold to produce the desired part or parts.

The major barrier in rheocasting is the difficulty to generate sufficient slurry within preferred temperature range in a short cycle time. Although the cost of thixocasting is higher due to the additional casting and remelting steps, the implementation of thixocasting in industrial production has far exceeded rheocasting because semi-solid feedstock can be cast in large quantities in separate operations which can be remote in time and space from the reheating and forming steps.

In a semi-solid casting process, generally, a slurry is formed during solidification consisting of dendritic solid particles whose form is preserved. Initially, dendritic particles nucleate and grow as equiaxed dendrites within the molten alloy in the early stages of slurry or semi-solid formation. With the appropriate cooling rate and stirring, the dendritic particle branches grow larger and the dendrite arms have time to coarsen so that the primary and secondary dendrite arm spacing increases. During this growth stage in the presence of stirring, the dendrite arms come into contact and become fragmented to form degenerate dendritic particles. At the holding temperature, the particles continue to coarsen and become more rounded and approach an ideal spherical shape. The extent of rounding is controlled by the holding time selected for the process. With stirring, the point of "coherency" (the dendrites become a tangled structure) is not reached. The semi-solid material comprised of fragmented, degenerate dendrite particles continues to deform at low shear forces.

When the desired fraction solid and particle size and shape have been attained, the semi-solid material is ready to be formed by injecting into a die-mold or some other forming process. Solid phase particle size is controlled in the process by limiting the slurry creation process to temperatures above the point at which the solid phase begins to form and particle coarsening begins.

It is known that the dendritic structure of the primary solid of a semi-solid alloy can be modified to become nearly spherical by introducing the following perturbation in the liquid alloy near liquidus temperature or semi-solid alloy:

1) Stirring: mechanical stirring or electromagnetic stirring;
2) Agitation: low frequency vibration, high-frequency wave, electric shock, or electromagnetic wave;
3) Equiaxed Nucleation: rapid under-cooling, grain refiner;
4) Oswald Ripening and Coarsening: holding alloy in semi-solid temperature for a long time.

While the methods in (2)–(4) have been proven effective in modifying the microstructure of semi-solid alloy, they have the common limitation of not being efficient in the processing of a high volume of alloy with a short preparation time due to the following characteristics or requirements of semi-solid metals:

High dampening effect in vibration.

Small penetration depth for electromagnetic waves.

High latent heat against rapid under-cooling.

Additional cost and recycling problem to add grain refiners.

Natural ripening takes a long time, precluding a short cycle time.

While most of the prior art developments have been focused on the microstructure and rheology of semi-solid alloy, temperature control has been found by the present inventors to be one of the most critical parameters for reliable and efficient semi-solid processing with a comparatively short cycle time. As the apparent viscosity of semi-solid metal increases exponentially with the solid fraction, a small temperature difference in the alloy with 40% or higher solid fraction results in significant changes in its fluidity. In fact, the greatest barrier in using methods (2)–(4), as listed above, to produce semi-solid metal is the lack of stirring. Without stirring, it is very difficult to make alloy slurry with the required uniform temperature and microstructure, especially when the there is a requirement for a high volume of the alloy. Without stirring, the only way to heat/cool semi-solid metal without creating a large temperature difference is to use a slow heating/cooling process. Such a process often requires that multiple billets of feedstock be processed simultaneously under a pre-programmed furnace and conveyor system, which is expensive, hard to maintain, and difficult to control.

While using high-speed mechanical stirring within an annular thin gap can generate high shear rate sufficient to break up the dendrites in a semi-solid metal mixture, the thin gap becomes a limit to the process's volumetric throughput. The combination of high temperature, high corrosion (e.g. of molten aluminum alloy) and high wearing of semi-solid slurry also makes it very difficult to design, to select the proper materials and to maintain the stirring mechanism.

Prior references disclose the process of forming a semi-solid slurry by reheating a solid billet formed by thixocasting or directly from the melt using mechanical or electromagnetic stirring. The known methods for producing semi-solid alloy slurries include mechanical stirring and inductive electromagnetic stirring. The processes for forming a slurry with the desired structure are controlled, in part, by the interactive influences of the shear and solidification rates.

In the early 1980's, an electromagnetic stirring process was developed to cast semi-solid feedstock with discrete degenerate dendrites. The feedstock is cut to proper size and then remelt to semi-solid state before being injected into mold cavity. Although this magneto hydrodynamic (MHD) casting process is capable of generating high volume of semi-solid feedstock with adequate discrete degenerate dendrites, the material handling cost to cast a billet and to remelt it back to a semi-solid composition reduces the competitiveness of this semi-solid process compared to other casting processes, e.g. gravity casting, low-pressure die-casting or high-pressure die-casting. Most of all, the complexity of billet heating equipment, the slow billet heating process and the difficulties in billet temperature control have been the major technical barriers in semi-solid forming of this type.

The billet reheating process provides a slurry or semi-solid material for the production of semi-solid formed (SSF) products. While this process has been used extensively, there is a limited range of castable alloys. Further, a high fraction of solids (0.7 to 0.8) is required to provide for the mechanical strength required in processing with this form of feedstock. Cost has been another major limitation of this approach due to the required processes of billet casting, handling, and reheating as compared to the direct application of a molten metal feedstock in the competitive die and squeeze casting processes.

In the mechanical stirring process to form a slurry or semi-solid material, the attack on the rotor by reactive metals results in corrosion products that contaminate the solidifying metal. Furthermore, the annulus formed between the outer edge of the rotor blades and the inner vessel wall within the mixing vessel results in a low shear zone while shear band formation may occur in the transition zone between the high and low shear rate zones. There have been a number of electromagnetic stirring methods described and used in preparing slurry for thixocasting billets for the SSF process, but little mention has been made of an application for rheocasting.

The rheocasting, i.e., the production by stirring of a liquid metal to form semi-solid slurry that would immediately be shaped, has not been industrialized so far. It is clear that rheocasting should overcome most of limitations of thixocasting. However, in order to become an industrial production technology, i.e., producing stable, deliverable semi-solid slurry on-line (i.e., on-demand) rheocasting must overcome the following practical challenges: cooling rate control, microstructure control, uniformity of temperature and microstructure, the large volume and size of slurry, short cycle time control and the handling of different types of alloys, as well as the means and method of transferring the slurry to a vessel and directly from the vessel to the casting shot sleeve.

While propeller-type mechanical stirring has been used in the context of making a semi-solid slurry, there are certain problems and limitations. For example, the high temperature and the corrosive and high wearing characteristics of semi-solid slurry make it very difficult to design a reliable slurry apparatus with mechanical stirring. However, the most critical limitation of using mechanical stirring in rheocasting is that its small throughput cannot meet the requirements of production capacity. It is also known that semi-solid metal with discrete degenerated dendrite can also be made by introducing low frequency mechanical vibration, high-frequency ultra-sonic waves, or electric-magnetic agitation with a solenoid coil. While these processes may work for smaller samples at slower cycle time, they are not effective in making larger billet because of the limitation in penetration depth. Another type of process is solenoidal induction agitation, because of its limited magnetic field penetration depth and unnecessary heat generation, it has many technological problems to implement for productivity. Vigorous electromagnetic stirring is the most widely used industrial process permits the production of a large volume of slurry. Importantly, this is applicable to any high-temperature alloys.

Two main variants of vigorous electromagnetic stirring exist, one is rotational stator stirring, and the other is linear stator stirring. With rotational stator stirring, the molten metal is moving in a quasi-isothermal plane, therefore, the degeneration of dendrites is achieved by dominant mechanical shear. U.S. Pat. No. 4,434,837, issued Mar. 6, 1984 to Winter et al., describes an electromagnetic stirring apparatus for the continuous making of thixotropic metal slurries in which a stator having a single two pole arrangement generates a non-zero rotating magnetic field which moves transversely of a longitudinal axis. The moving magnetic field provides a magnetic stirring force directed tangentially to the metal container, which produces a shear rate of at least 50 $sec^{-1}$ to break down the dendrites. With linear stator stirring, the slurries within the mesh zone are re-circulated to the higher temperature zone and remelted, therefore, the thermal processes play a more important role in breaking down the dendrites. U.S. Pat. No. 5,219,018, issued Jun. 15, 1993 to Meyer, describes a method of producing thixotropic metallic products by continuous casting with polyphase current electromagnetic agitation. This method achieves the conversion of the dendrites into nodules by causing a refusion of the surface of these dendrites by a continuous transfer of the cold zone where they form towards a hotter zone.

It is known in the art that thixotropic metal melts may be stirred by the application of a sufficiently strong magnetomotive force. Known techniques for generating such a magnetomotive force include using one or more static magnetic fields, a combination of static and variable magnetic fields, moving magnetic fields, or rotating magnetic fields to stir the metal melt. However, all of these techniques suffer from the same disadvantage of inducing three-dimensional circulation primarily at the container walls, resulting in inhomogeneous mixing of the metal melt. While the above-mentioned known magnetomotive mixing techniques all produce a shear force on the thixotropic melt by inducing rotational movement thereof, three-dimensional circulation is only achieved to the extent that centripetal forces acting on the rotating melt force a top layer of molten metal against the container wall where it travels down the wall and back into the melt at a lower level. Although sufficient to maintain the thixotropic character of the melt, this process is inefficient for uniformly equilibrating the temperature or composition of the entire melt. Obviously, it would be desirable to stir the melt so as to maintain its thixotropic character while simultaneously quickly and efficiently transferring heat between the melt and its surroundings. The present invention is directed toward achieving this goal.

SUMMARY OF THE INVENTION

The present invention relates to a method and apparatus for magnetomotively stirring a metallic melt so as to maintain its thixotropic character (prevent bulk crystallization) by simultaneously quickly and efficiently degenerating dendritic particles formed therein and transferring heat between the melt and its surroundings. One form of the present invention is a stacked stator assembly including a stator ring adapted to generate a linear/longitudinal magnetic field positioned between two stator rings adapted to generate a rotational magnetic field. The stacked stator rings define a generally cylindrical magnetomotive mixing region therein.

One object of the present invention is to provide an improved magnetomotive metal melt stirring system. Related objects and advantages of the present invention will be apparent from the following description.

DETAILED DESCRIPTION OF THE PREFERRED EMBODIMENT

Figure 1A:
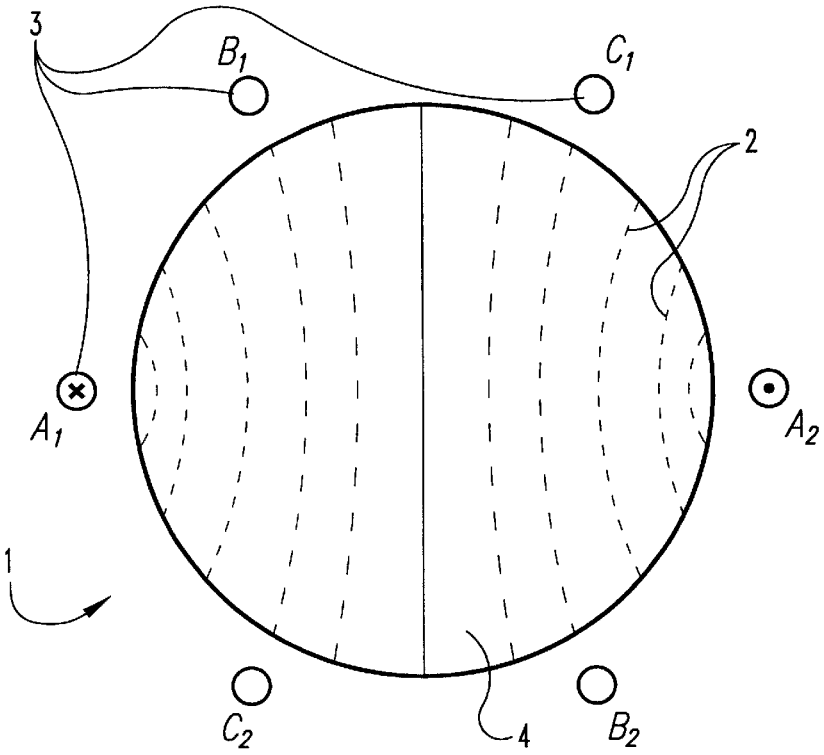
Fig. 1A (Prior Art)
FIG. 1A is a schematic illustration of a 2-pole multiphase stator.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

One of the ways to overcome the above challenges, according to the present invention, is to apply modified electromagnetic stirring of substantially the entire liquid metal volume as it solidifies into and through the semi-solid range. Such modified electromagnetic stirring enhances the heat transfer between the liquid metal and its container to control the metal temperature and cooling rate, and generates a sufficiently high shear inside of the liquid metal to modify the microstructure to form discrete degenerate dendrites. Modified electromagnetic stirring increases the uniformity of metal temperature and microstructure by means of increased control of the molten metal mixture. With a careful design of the stirring mechanism and method, the stirring drives and controls a large volume and size of semi-solid slurry, depending on the application requirements, Modified electromagnetic stirring allows the cycle time to be shortened through increased control of the cooling rate. Modified magnetic stirring may be adapted for use with a wide variety of alloys, i.e., casting alloys, wrought alloys, MMC, etc. It should be noted that the mixing requirement to produce and maintain a semi-solid metallic slurry is quite different from that to produce a metal billet through the MHD process, since a billet formed according to the MHD process will have a completely solidified surface layer, while a billet formed from a semi-solid slurry will not.

Figure 1B:
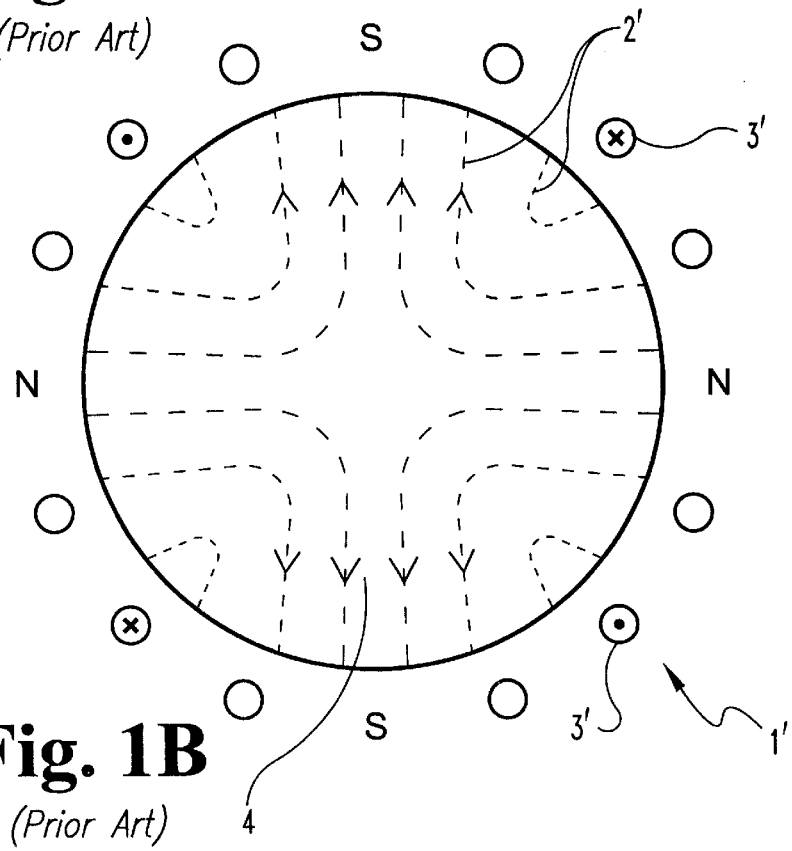
Fig. 1B (Prior Art)
FIG. 1B is a schematic illustration of a multipole stator.

In the past, MHD stirring has been achieved by utilizing a 2-pole multiphase stator system to generate a magnetomotive stirring force on a liquid metal. While multipole stator systems are well known, they have not been in the MHD process because, for a given line frequency, multiphase stator systems generate rotating magnetic fields having only one half the rotational speed of fields produced by 2-pole stator systems. FIG. 1A schematically illustrates a 2-pole multiphase stator system 1 and its resulting magnetic field 2, while FIG. 1B schematically illustrates a multipole stator system 1' and its respective magnetic field 2'. In general, each stator system 1, 1' includes a plurality of pairs of electromagnetic coils or windings 3, 3' oriented around a central volume 4, 4' respectively. The windings 3, 3' are sequentially energized by flowing electric current therethrough.

FIG. 1A illustrates a 3-phase 2-pole multiphase stator system 1 having three pairs of windings 3 positioned such that there is a 120 degree phase difference between each pair. The multiphase stator system 1 generates a rotating magnetic field 2 in the central volume 4 when the respective pairs of windings 3 are sequentially energized with electric current. In the instant case, there are three pairs of windings 3 oriented circumferentially around a cylindrical mixing volume 4, although other designs may employ other numbers of windings 3 having other orientations.

Figure 1C:
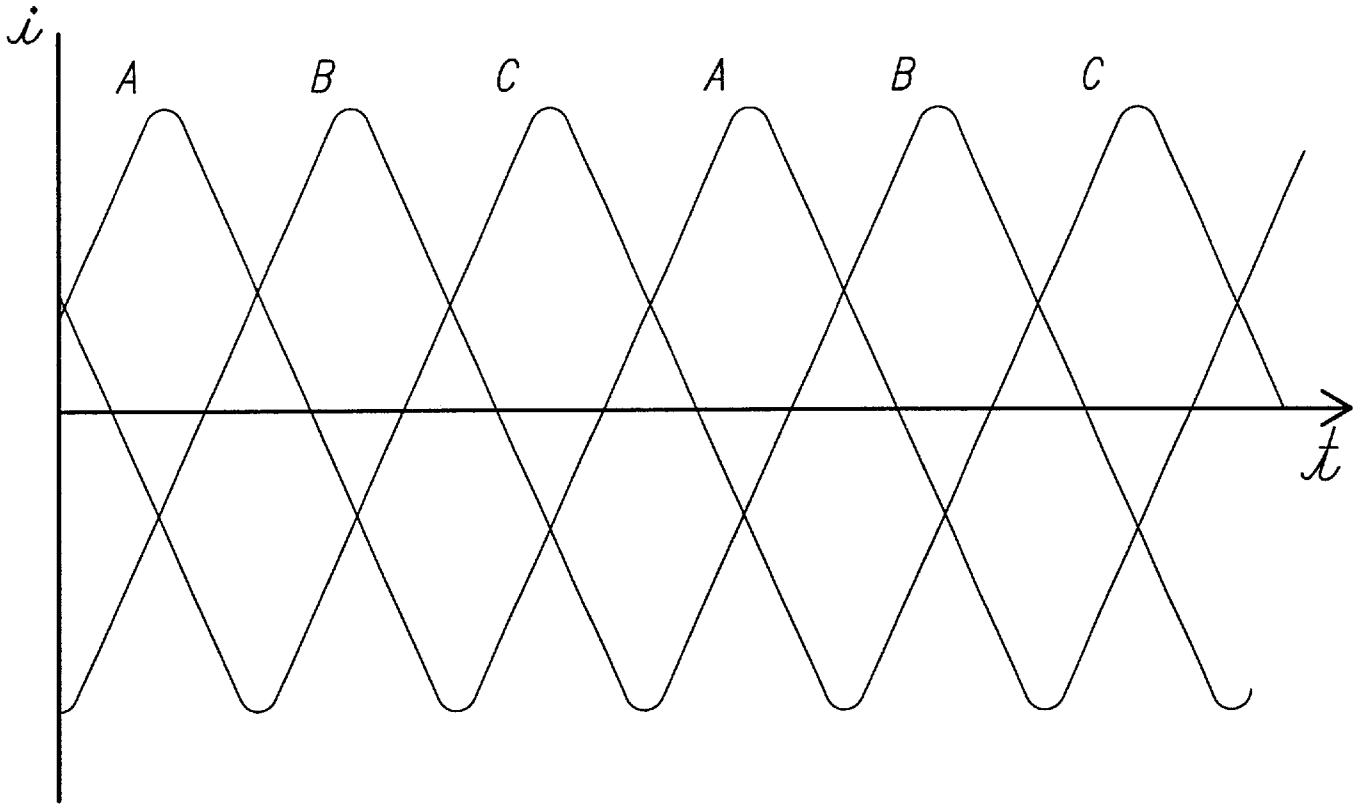
Fig. 1C (Prior Art)
FIG. 1C is a graphic illustration of the electric current as a function of time for each pair of coils of the stator in FIG. 1A.

Typically, the windings or coils 3 are electrically connected so as to form a phase spread over the stirring volume 4. FIG. 1C illustrates the relationship of electric current through the windings 3 as a function of time for the windings 3.

In use, the magnetic field 2 varies with the change in current flowing through each pair of windings 3. As the magnetic field 2 varies, a current is induced in a liquid electrical conductor occupying the stirring volume 4. This induced electric current generates a magnetic field of its own. The interaction of the magnetic fields generates a stirring force acting on the liquid electrical conductor urging it to flow. As the magnetic field rotates, the circumferential magnetomotive force drives the liquid metal conductor to circulate. It should be noted that the magnetic field 2 produced by a multipole system (here, by a 2-pole system) has an instantaneous cross-section bisected by a line of substantially zero magnetic force.

Figure 1D:
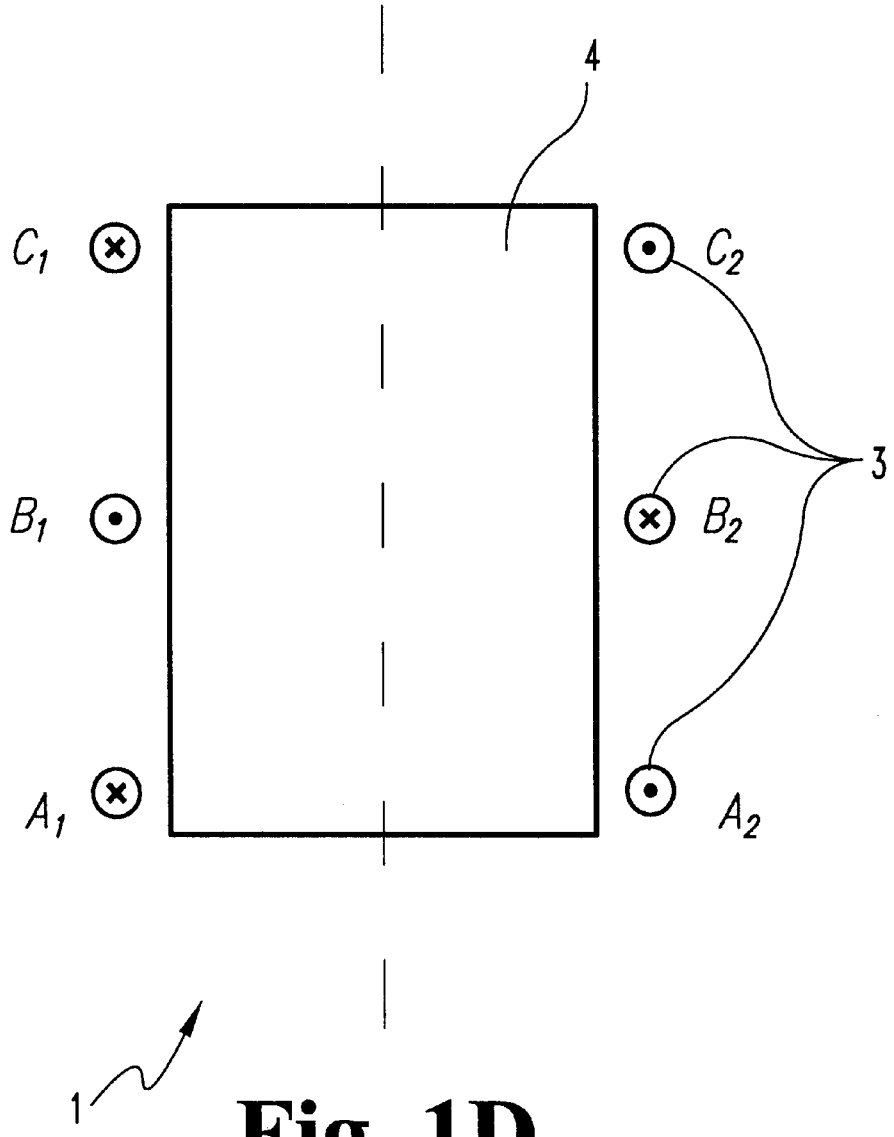
Fig. 1D (Prior Art)
FIG 1D is a schematic illustration of a multiphase stator having pairs of coils positioned longitudinally relative a cylindrical mixing volume.

FIG. 1D illustrates a set of windings 3 positioned longitudinally relative a cylindrical mixing volume 4. In this configuration, the changing magnetic field 2 induces circulation of the liquid electrical conductor in a direction parallel to the axis of the cylindrical volume 4.

In FIG. 1B, a multipole stator system 1' is illustrated having four poles, although the system 1' may have any even integral number P of poles. Assuming sinusoidal distribution, the magnetic field B is expressed as $$B=B_m\cos P/2\theta_s,$$

where $B_m$ is the magnetic density at a given reference angle $\theta_{s\ is}$. The value P/2 is often referred to as the electrical angle. It should be noted that the magnetic field 4' produced by the multipole multiphase stator system 1' produces a resultant magnetic field 2' having two-dimensional cross-section with a central area of substantially zero magnetic field.

Typically, known MHD systems for stirring molten metals use a single 2-pole multiphase stator to rapidly stir a metal melt. One disadvantage of using such a system is the requirement of excessive stirring forces applied to the outer radius of the melt in order to assure the application of sufficient stirring forces at the center of the melt. Additionally, while a single multiphase multistator system is usually sufficient to thoroughly stir a molten metal volume, it may be insufficient to provide uniformly controlled mixing throughout the melt. Controlled and uniform mixing is important insofar as it is necessary for maintaining a uniform temperature and viscosity throughout the melt, as well as for optimizing heat transfer from the melt for its rapid precision cooling. In contrast to the steady-state temperature and heat transfer characteristics of the MHD process, the production of a semi-solid thixotropic slurry requires rapid and controlled temperature changes to occur uniformly throughout the slurry in a short period of time. Moreover, in the thixotropic range, as the temperature decreases the solid fraction, and accordingly the viscosity, rapidly increases. In this temperature and viscosity range, it is desirable to maintain steady, uniform stirring throughout the entire volume of material. This is especially true as the volume of molten metal increases.

To this end, the present invention utilizes a combination of stator types to combine circumferential magnetic stirring fields with longitudinal magnetic stirring fields to achieve a resultant three-dimensional magnetic stirring field that urges uniform mixing of the metal melt. One or more multiphase stators are included in the system, to allow greater control of the three-dimensional penetration of the resulting magnetomotive stirring field. In other words, while the MHD process requires a stator having only two poles and producing a non-zero electromotive field across the entire cross-section of the metal melt or billet, the system of the present invention utilizes a combination of stator types to achieve greater control of the resulting magnetomotive mixing field. Otherwise, as the outer layer of the volume of molten metal solidifies, the shear force on the remaining liquid metal in the interior of the volume would be insufficient to maintain dendritic degeneration, resulting in a metal billet having an inhomogeneous microstructure. In order to produce a thixotropic slurry billet, a stator assembly having four poles may be used to stir the slurry billet with greater force and at a faster effective rate to mix the cooling metal more thoroughly (and uniformly throughout the slurry billet volume) to produce a slurry billet that is more homogeneous, both in temperature and in solid particle size, shape, concentration and distribution. The four pole stator produces faster stirring since, although the magnetic field rotates more slowly than that of a two pole stator, the field is more efficiently directed into the stirred material and therefore stirs the melt faster and more effectively.

FIGS. 2A, 3A–3B, and 4A–4F illustrate a first embodiment of the present invention, a magnetomotive agitation system 10 for stirring volumes of molten metals (such as melts or slurry billets) 11. As used herein, the term "magnetomotive" refers to the electromagnetic forces generated to act on an electrically conducting medium to urge it into motion. The magnetomotive agitation system 10 includes a stator set 12 positioned around a magnetic mixing chamber 14 and adapted to provide a complex magnetic field therein. Preferably, the mixing chamber 14 includes an inert gas atmosphere 15 maintained over the slurry billet 11 to prevent oxidation at elevated temperatures.

Figure 2B:
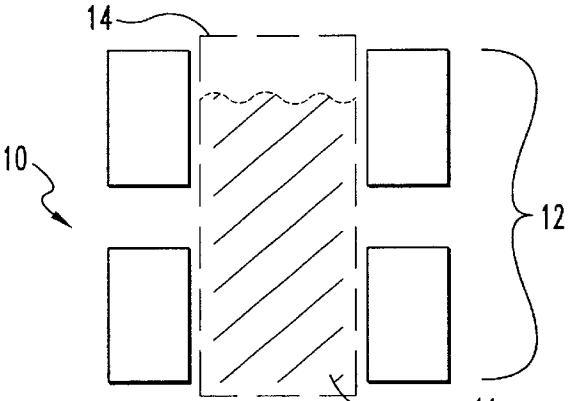
FIG. 2B is a schematic front elevational view of a magnetomotive stirring volume defined by a stacked stator assembly having two individual stators according to a second embodiment of the present invention.
Figure 2C:
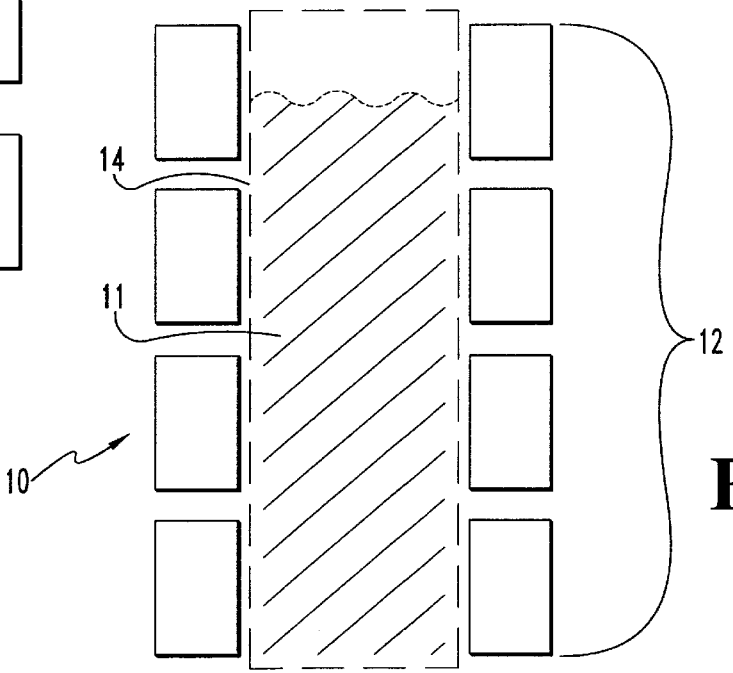
FIG. 2C is a schematic front elevational view of a magnetomotive stirring volume defined by a stacked stator assembly having four individual stators according to a third embodiment of the present invention.
Figure 2A:
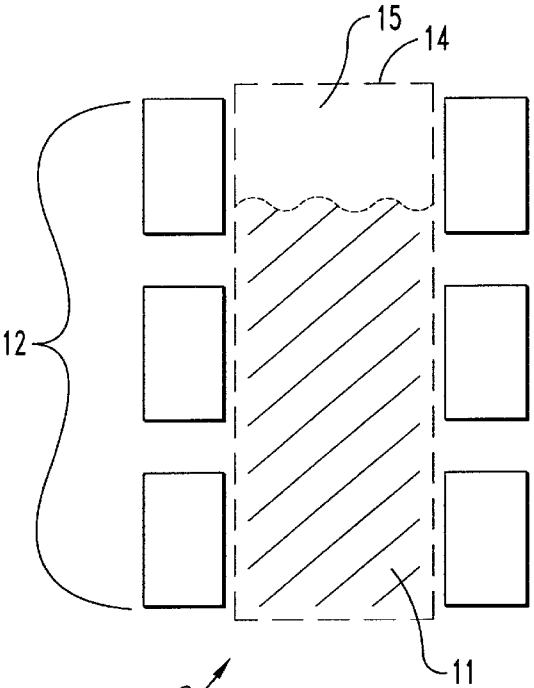
FIG. 2A is a schematic front elevational view of a magnetomotive stirring volume defined by a stacked stator assembly having three individual stators according to a first embodiment of the present invention.
Figure 2D:
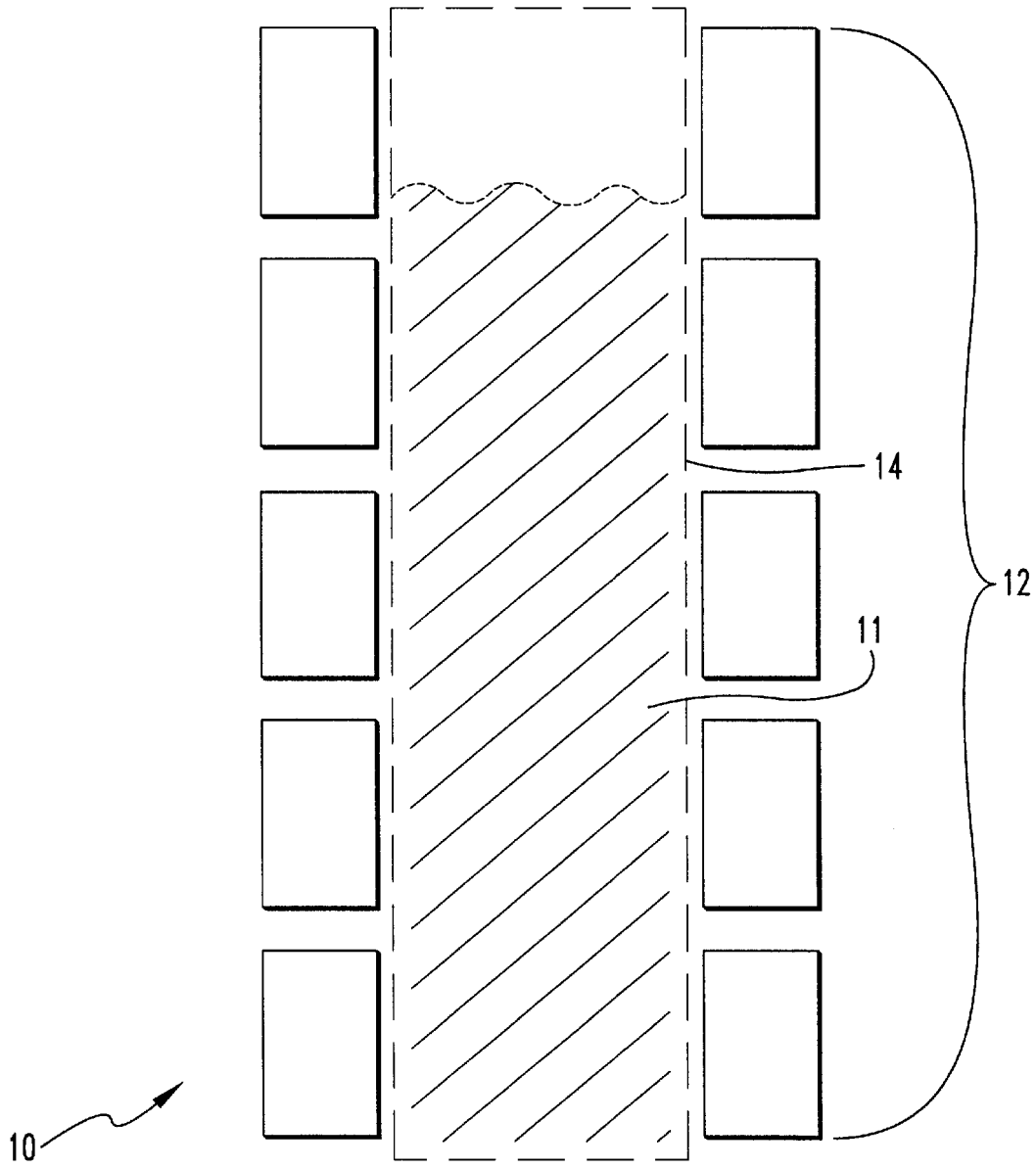
FIG. 2D is a schematic front elevational view of a magnetomotive stirring volume defined by a stacked stator assembly having five individual stators according to a fourth embodiment of the present invention.
Figures 3A, 3B:
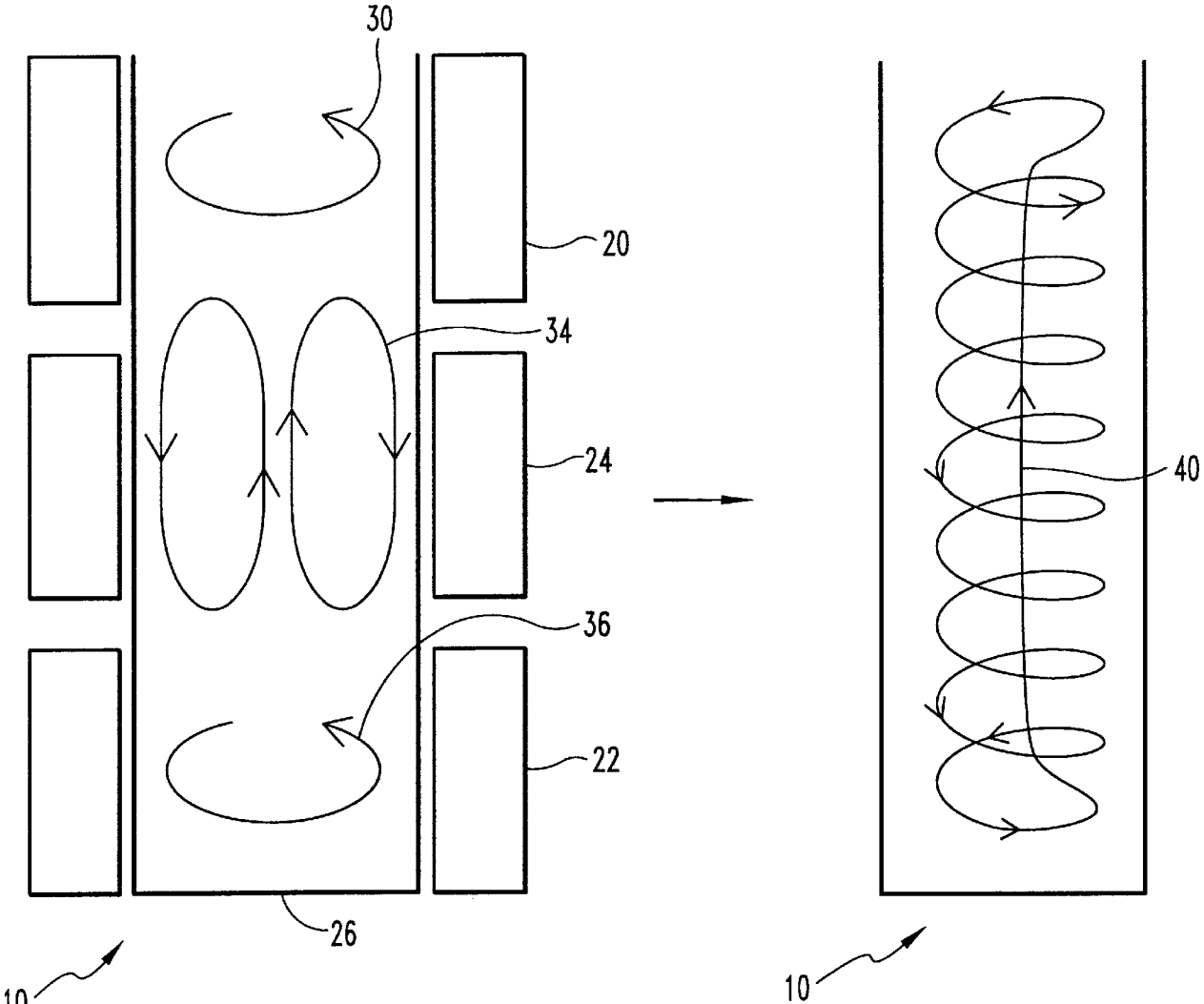
FIG. 3A is a schematic front elevational view of the magnetomotive stirring volume of FIG. 2A illustrating the simplified magnetic field interactions produced by each individual stator of a first stator assembly.
FIG. 3B is a schematic front elevational view of the combination of magnetomotive forces from each stator of the stator assembly of FIG. 3A to generate a substantially spiral resultant magnetic field.
Figure 3D:
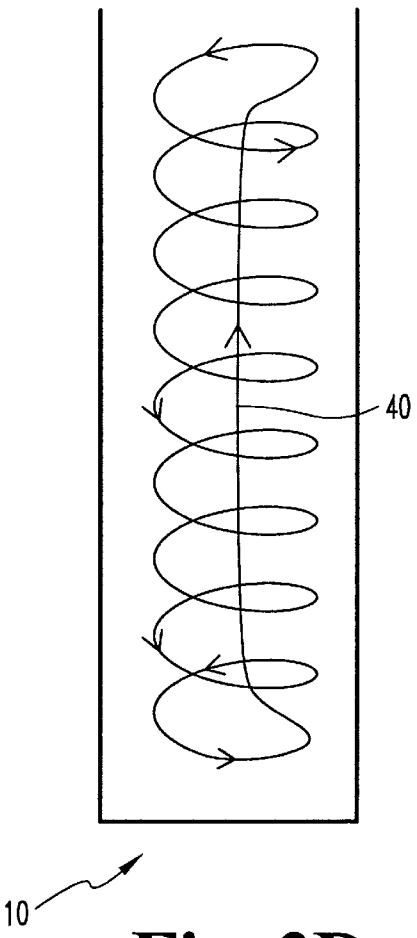
FIG. 3D is a schematic front elevational view of the combination of magnetomotive forces from each stator of the stator assembly of FIG. 3C to generate a substantially spiral resultant magnetic field.
Figure 3C:
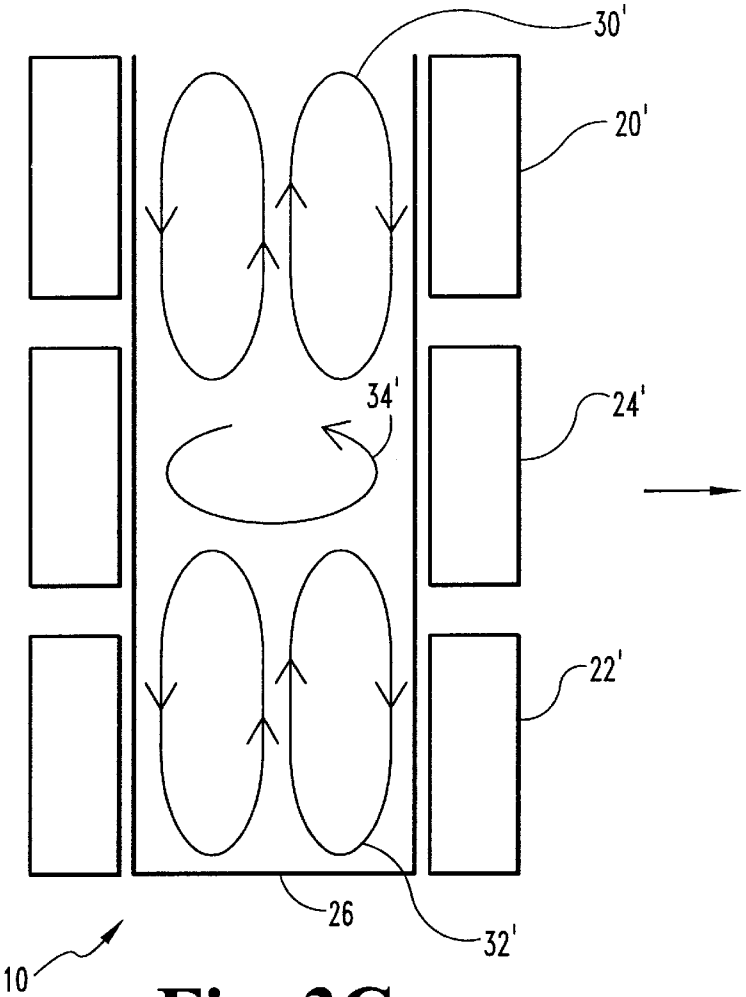
FIG. 3C is a schematic front elevational view of the magnetomotive stirring volume of FIG. 2A illustrating the simplified magnetic field interactions produced by each individual stator of a second stator assembly.

The stator set 12 preferably includes a first stator ring 20 and a second stator ring 22 respectively positioned above and below a third stator ring 24, although the stator set may include any number of stators (ring shaped or otherwise) of any type (linear field, rotational field, or the like) stacked in any convenient sequence to produce a desired net field magnetomotive shape and intensity (see, for example, FIGS. 2B–2D). As used herein, a 'rotating' or 'rotational' magnetic field is one that directly induces circulation of a ferromagnetic or paramagnetic liquid in a plane substantially parallel to a central axis of rotation 16 extending through the stator set 12 and the magnetic mixing volume 14. Likewise, as used herein, a 'linear' or 'longitudinal' magnetic field is one that directly induces circulation of a ferromagnetic or paramagnetic material in a plane substantially parallel the central axis of rotation 16. Preferably, the stator ring set 12 is stacked to define a right circular cylindrical magnetic mixing volume 14 therein, although the stator set 12 may be stacked to produce a mixing volume having any desired size and shape.

A physical mixing vessel or container 26 is positionable within the stator set 12 substantially coincident with the mixing volume 14. Preferably, the mixing vessel 26 defines an internal mixing volume 14 shape identical to that of the magnetomotive field generated by the stator ring set 12. For example, if a substantially right oval cylindrical magnetomotive force field were to be produced, the mixing vessel 26 would likewise preferably have an interior mixing volume 14 having a right oval cylindrical shape. Likewise, the stator set 12 may be stacked high to accommodate a relatively tall mixing vessel 26 or short to accommodate a small mixing vessel 26.

The first and second stators 20, 22 are preferably multiple phase stators capable of producing rotating magnetic fields 30, 32, while the third stator 24 is capable of producing a linear/longitudinal (axial) magnetic field 34. When all three stators 20, 22, 24 are actuated, the magnetic fields 30, 32, 34 so produced interact to form a complex substantially spiral or pseudo-spiral magnetomotive field 40. The substantially spiral magnetomotive field 40 produces an electromotive force on any electrical conductors in the magnetic mixing chamber 14, such that they are circulated throughout the melt 11, both axially and radially. Electrical conductors acted on by the spiral magnetomotive field 40 are therefore thoroughly randomized.

FIGS. 2A, 3C–3D, and 4A–4F illustrate an alternate embodiment of the present invention, a magnetomotive agitation system 10' as described above, but having a stator ring set 12' including a first and second stator 20', 22', each adapted to produce a linear magnetic field 30', 32', and a third stator 24' adapted to produce a rotational magnetic field 34'. As above, when all three stators 20', 22', 24' are actuated, the magnetic fields 30', 32', 34' so produced interact to form a complex substantially spiral or pseudo-spiral magnetomotive field 40. The substantially spiral magnetomotive field 40 produces an electromotive force on any electrical conductors in the magnetic mixing chamber 14, such that they are circulated throughout the melt 11, both axially and radially. Electrical conductors acted on by the spiral magnetomotive field 40 are therefore thoroughly dispersed. This stator set 12' design offers the advantage of directly inducing longitudinal circulation in both ends of the mixing volume 14 to ensure complete circulation of the slurry billet 11 at the ends of the mixing volume 14.

Figures 4A, 4B, 4C:
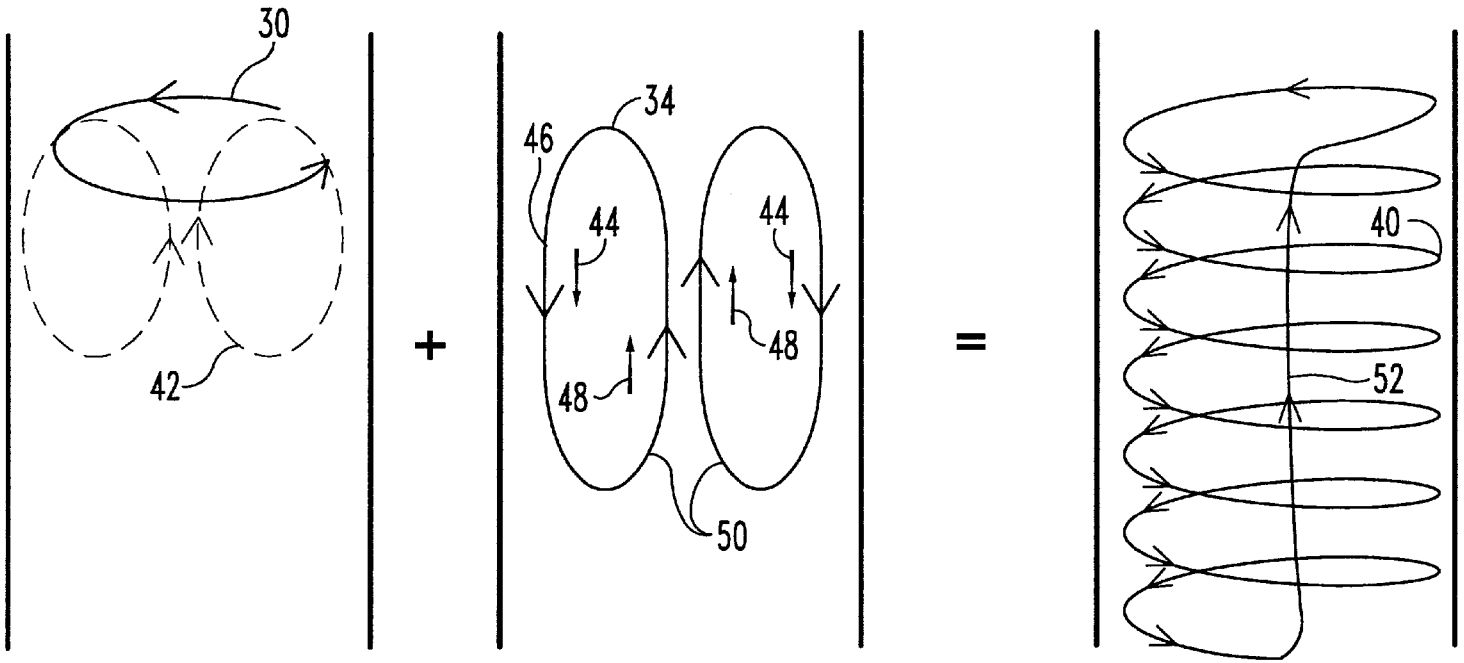
FIG. 4A is a schematic diagram illustrating the simplified shape of a magnetic field produced by a rotating field stator of FIG. 2A.
FIG. 4B is a schematic diagram illustrating the simplified shape of a magnetic field produced by a linear field stator of FIG. 2A.
FIG. 4C is a schematic diagram illustrating the simplified substantially spiral magnetic field produced by combining the rotating field and linear field stators of FIG. 2A.

FIGS. 4A–4F illustrate the stirring forces resulting from the interaction of the magnetic forces generated by the present invention in greater detail. FIGS. 4A–4C are a set of simplified schematic illustrations of the combination of a rotational or circumferential magnetic field 30 with a longitudinal or axial magnetic field to produce a resultant substantially spiral magnetic field 40. By itself, the rotational magnetic field produces some circulation 42 due to the centripetal forces urging stirred material against and down the vessel walls, but this is insufficient to produce even and complete circulation. This is due primarily to frictional forces producing drag at the interior surfaces of the mixing vessel 26. The circumferential flow generated by the rotational magnetic field 30 (shown here as a clockwise force, but may also be opted to be a counterclockwise force) is coupled with the axial flow generated by the longitudinal magnetic field 34 (shown here as a downwardly directed force, but may also be chosen to be an upwardly directed force) to produce a downwardly directed substantially spiral magnetic field 40. As the molten metal 11 flowing downward near the interior surface of mixing vessel 26 nears the bottom of the mixing volume 14, it is forced to circulate back towards the top of the mixing volume 14 through the core portion 48 (see FIGS. 4D–4F) of the mixing vessel 26, since the magnetomotive forces urging downward flow are stronger nearest the mixing vessel walls 26. Likewise, the direction of the longitudinal magnetic field 34 may be reversed to produce an upwardly directed flow of liquid metal having a downwardly directed axial portion. It should be noted that the stator set 12 may be controlled to produce net magnetic fields having shapes other than spirals, and in fact may be controlled to produce magnetic fields having virtually any desired shape. Likewise, it should also be noted that the spiral (or any other) shape of the magnetic filed may be achieved by any stator set having at least one stator adapted to produce a rotational field and at least one stator adapted to produce a linear field through the careful control of the field strengths produced by each stator and their interactions.

Figure 4F:
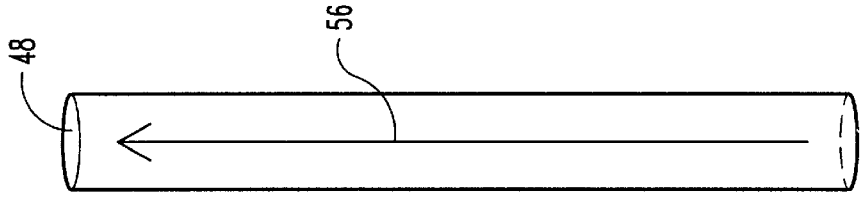
FIG. 4F is a perspective schematic view of the inner portion of FIG. 4D.
Figure 4E:
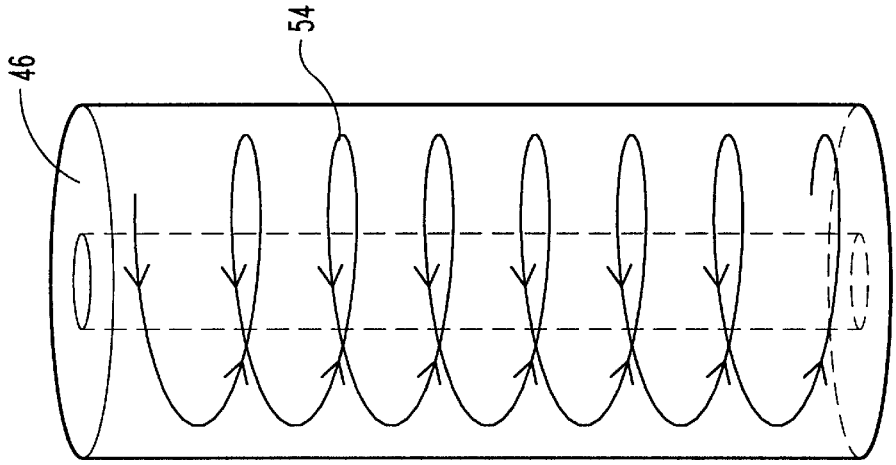
FIG. 4E is a perspective schematic view of the outer portion of FIG. 4D.
Figure 4D:
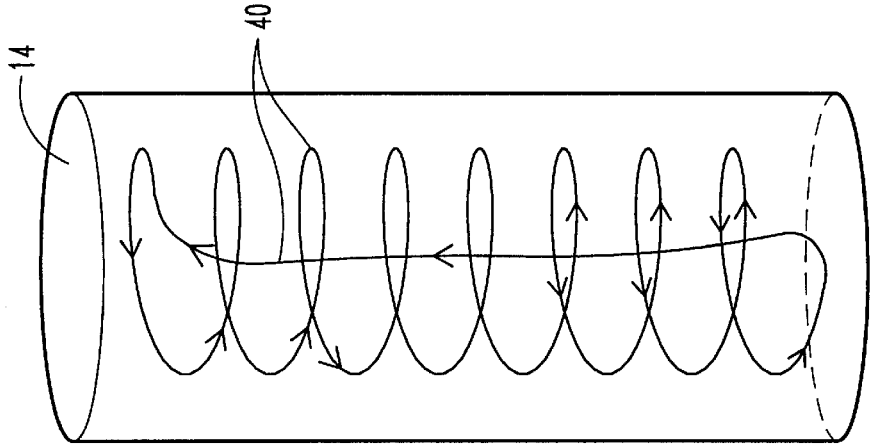
FIG. 4D is a perspective schematic view of the cylindrical spiral magnetomotive mixing volume of FIG. 2A separated to illustrate an inner cylindrical core portion and an outer cylindrical shell portion.

FIGS. 4D–4F schematically illustrate the preferred flow patterns occurring in a metal melt 11 magnetomotively stirred in the substantially cylindrical magnetic mixing chamber or volume 14. For ease of illustration, the magnetic mixing volume 14 is depicted as a right circular cylinder, but one of ordinary skill in the art would realize that this is merely a convenient approximation of the shape of the magnetomotive force field and that the intensity of the field is not a constant throughout its volume. The magnetic mixing volume 14 may be thought of as comprising a cylindrical outer shell 46 surrounding a cylindrical inner axial volume 48. The downwardly directed spiral portion 54 of the flowing liquid metal 11 is constrained primarily in the cylindrical outer shell 46 while the upwardly directed axial portion 56 of the flowing liquid metal 11 is constrained primarily in the cylindrical inner axial volume 48.

In general, it is preferred that a thixotropic metal melt 11 be stirred rapidly to thoroughly mix substantially the entire volume of the melt 11 and to generate high shear forces therein to prevent dendritic particle formation in the melt 11 through the application of high shear forces to degenerate forming dendritic particles into spheroidal particles. Stirring will also increase the fluidity of the semi-solid metal melt 11 and thereby enhance the efficiency of heat transfer between the forming semi-solid slurry billet 11 and the mixing vessel 26. Rapid stirring of the low viscosity melt also tends to speed temperature equilibration and reduce thermal gradients in the forming semi-solid slurry billet 11, again enjoying the benefits of more thoroughly and efficiently mixing the semi-solid slurry billet 11.

It is further preferred that the stirring rate be decreased as the viscosity of the cooling melt/forming semi-solid slurry billet 11 increases, since as the solid fraction (and thereby the viscosity) of the slurry billet 11 increases the required shear forces to maintain a high stirring rate likewise increase and it is desirable to mix the high viscosity slurry billet 11 with high-torque low-speed stirring (since low speed magnetic stirring is produced by using more penetrating low frequency oscillations.) The stirring rate may be conveniently controlled as a function of the viscosity of the melt (or as a function of a parameter coupled to the viscosity, such as the temperature of the melt or the power required to stir the melt), wherein as the viscosity of the cooling melt 11 increases, the stirring rate decreases according to a predetermined relationship or function.

In operation, a volume of molten metal (i.e., a slurry billet) 11 is poured into the mixing vessel 26 positioned within the mixing volume 14. The stator set 12 is activated to produce a magnetomotive field 40 within the magnetic mixing chamber 14. The magnetomotive field 40 is preferably substantially spiral, but may be made in any desired shape and/or direction. The stator set 12 is sufficiently powered and configured such that the magnetomotive field produced thereby is sufficiently powerful to substantially penetrate the entire slurry billet 11 and to induce rapid circulation throughout the entire slurry billet 11. As the slurry billet 11 is stirred, its temperature is substantially equilibrated throughout its volume such that temperature gradients throughout the slurry billet 11 are minimized. Homogenization of the temperature throughout the slurry billet 11 likewise homogenizes the billet viscosity and the size and distribution of forming solid phase particles therein.

The slurry billet 11 is cooled by heat transfer through contact with the mixing vessel 26. Maintenance of a rapid and uniform stirring rate is preferred to facilitate uniform and substantially homogenous cooling of the slurry billet 11. As the slurry billet 11 cools, the size and number of solid phase particles therein increases, as does the billet viscosity and the amount of shear force required to stir the slurry billet 11. As the slurry billet 11 cools and its viscosity increases, the magnetomotive force field 14 is adjusted according to a predetermined relationship between slurry billet (or melt) viscosity and desired stirring rate.

Figure 5:
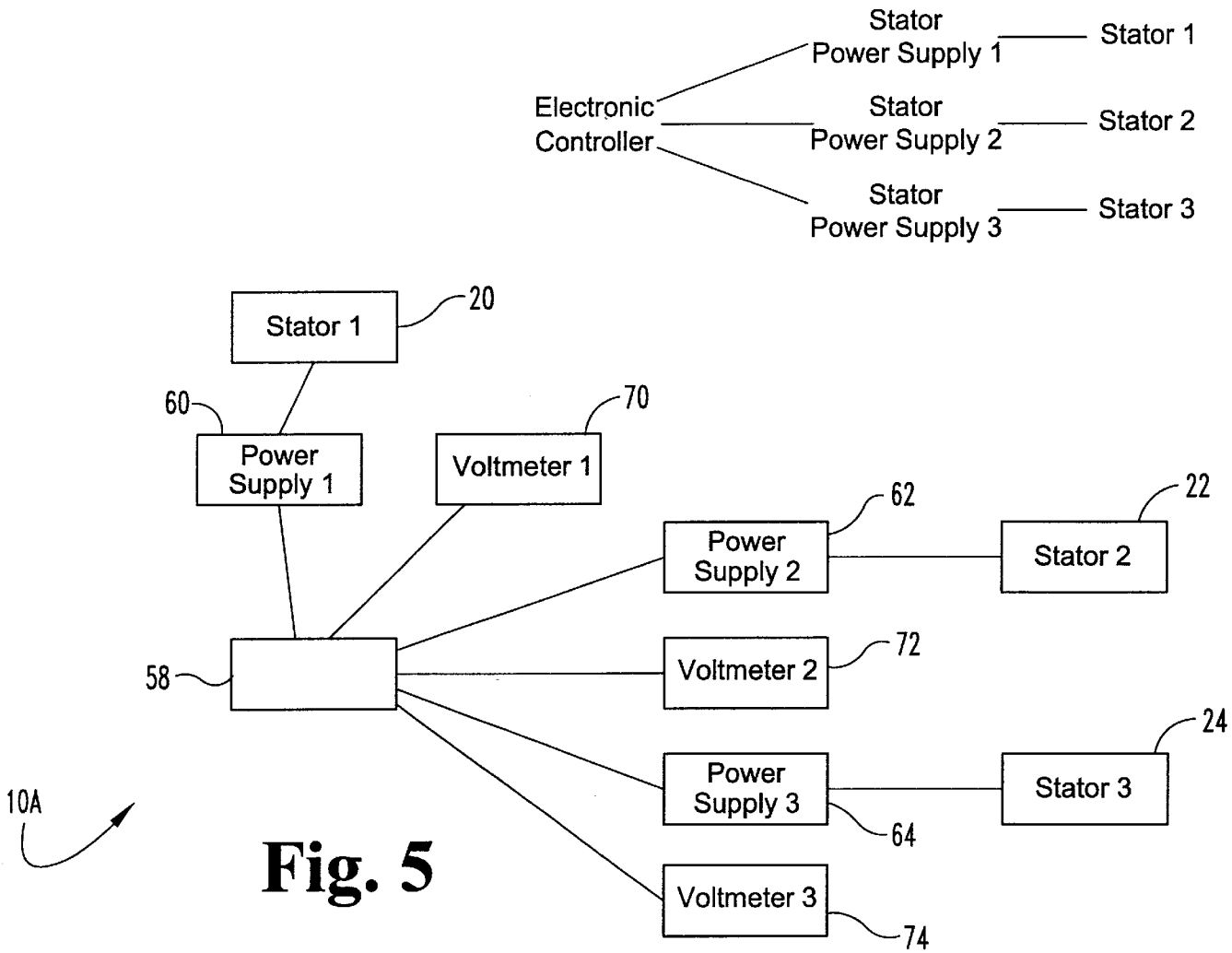
FIG. 5 is a schematic view of a sixth embodiment of the present invention, a magnetomotive stirring apparatus having an electronic controller connected to a stator assembly and receiving voltage feedback.

FIG. 5 schematically illustrates a still another embodiment of the present invention, a magnetomotive agitation system 10A for stirring thixotropic molten metallic melts including an electronic controller 58 electrically connected to a first stator 20, a second stator 22 and a third stator 24. A first power supply 60, a second power supply 62 and a third power supply 64 are electrically connected to the respective first, second and third stators 20, 22, 24 as well as to the electronic controller 58. A first voltmeter 70, a second voltmeter 72 and a third voltmeter 74 are also electrically connected to the respective power supplies 60, 62, 64 and to the electronic controller 58.

In operation, the power supplies 60, 62, 64 provide power to the respective stators 20, 22, 24 to generate the resultant substantially spiral magnetic field 40. The electronic controller 58 is programmed to provide control signals to the respective stators 20, 22, 24 (through the respective power supplies 60, 62, 64) and to receive signals from the respective voltmeters 70, 72, 74 regarding the voltages provided by the respective power supplies 60, 62, 64. The electronic controller 58 is further programmed to correlate the signals received from the voltmeters 70, 72, 74 with the shear forces in the melt/slurry billet 11, to calculate the viscosity of the forming semi solid slurry billet 11, and to control the stators 20, 22, 24 to decrease the intensity of the substantially spiral magnetic field 40 to slow the stirring rate as the slurry billet 11 viscosity increases. Alternately, a feedback signal relating to the temperature or viscosity of the molten metal 11 may be used to provide a control signal to the electronic controller 58 for controlling the stator set 12.

Figure 6:
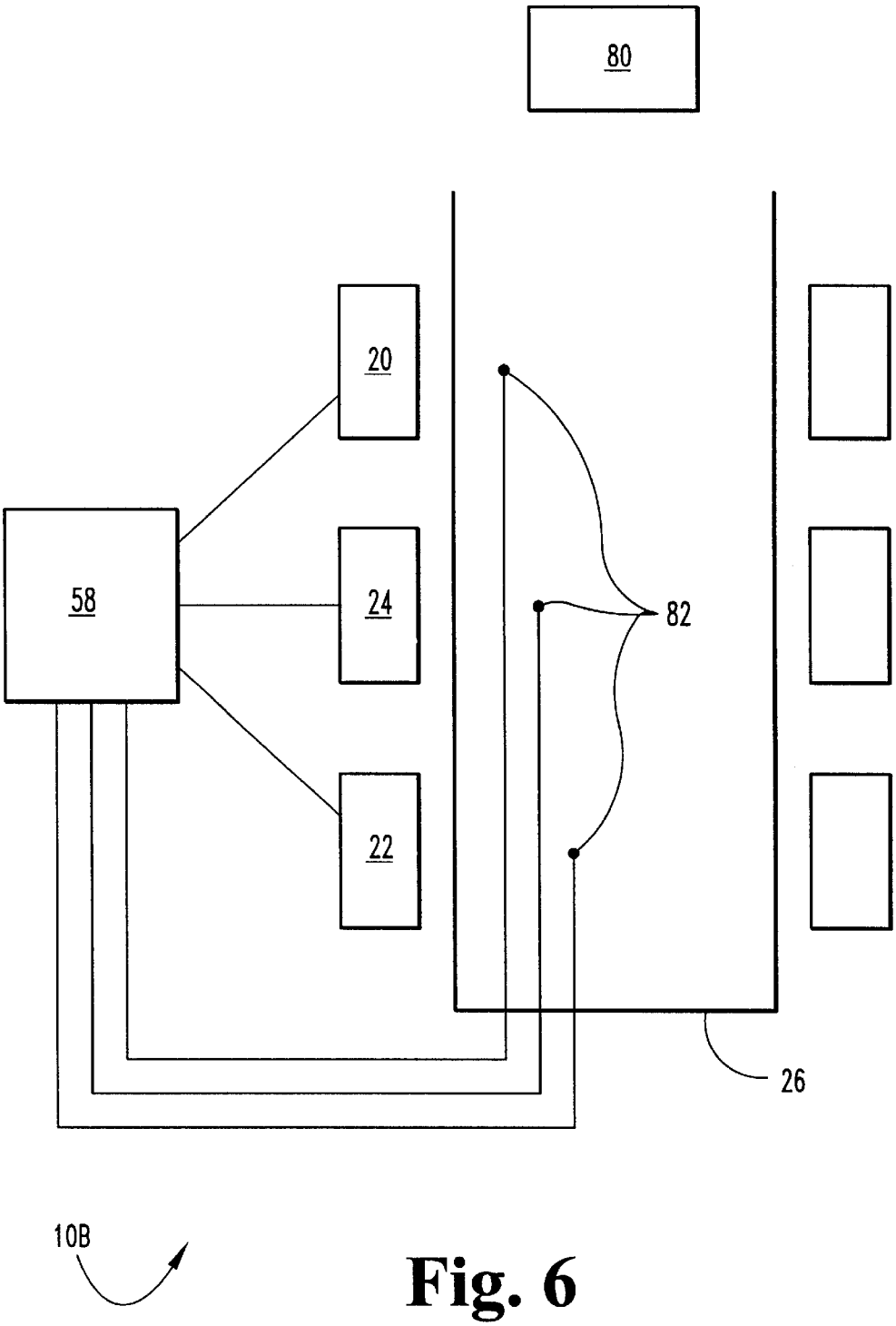
FIG. 6 is a schematic view of a seventh embodiment of the present invention, a magnetomotive stirring apparatus having an electronic controller connected to a stator assembly and receiving temperature feedback from temperature sensors.

FIG. 6 illustrates yet another embodiment of the present invention a magnetomotive agitation system 10B for stirring a thixotropic metalic melt 11 contained in a mixing vessel 26 and including an electronic controller 58 electrically connected to a first stator 20, a second stator 22 and a third stator 24. The electronic controller 58 is also electrically connected to one or more temperature sensors 80, 82 such as an optical pyrometer 80 positioned to optically sample the metallic melt 11 or a set of thermocouples 82 positioned to detect the temperature of the metalic melt 11 at different points within the mixing vessel 26.

In operation, the electronic controller 58 is programmed to provide control signals to the respective stators 20, 22, 24 (through one or more power supplies, not shown) and to receive signals from the temperature sensor(s) 80, 82 regarding the temperature of the cooling molten metal/forming semi-solid slurry billet 11. The electronic controller 58 is further programmed to correlate the temperature of the metal melt/slurry billet 11 with a predetermined desired stirring speed (based on a known relationship between slurry viscosity and temperature for a given metallic composition) and to control the stators 20, 22, 24 to change the intensity of the substantially spiral magnetic field 40 to control the stirring rate as a function of temperature of the slurry billet 11. In other words, as the temperature of the slurry billet 11 decreases, the electronic controller 58 is adapted to control the stators 20, 22, 24 to adjust the stirring rate of the slurry billet 11.

Other embodiments are contemplated wherein the stator assembly comprises a single stator capable of producing a complex spiral magnetomotive force field. Still other contemplated embodiments include a single power supply adapted to power the stator assembly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An apparatus for magnetically stirring a flowable material, comprising:

a mixing vessel for containing a volume of the flowable material; and at least one magnetic field generator positioned adjacent said mixing vessel and adapted to produce a magnetic field having a rotational component and an axial component; and wherein said rotational and axial components of said magnetic field act upon the volume of flowable material to stir the volume of flowable material within said mixing vessel.

2. The apparatus of claim 1 wherein said rotational and axial components of said magnetic field interact to form a substantially spiral magnetic field.

3. The apparatus of claim 1 wherein the flowable material is a metallic alloy.

4. The apparatus of claim 1 wherein the flowable material is a slurry billet.

5. The apparatus of claim 1 wherein said at least one magnetic field generator has a substantially cylindrical configuration extending about said mixing vessel.

6. The apparatus of claim 1 wherein said at least one magnetic field generator comprises a first stator adapted to produce said rotational component of said magnetic field and a second stator adapted to produce said axial component of said magnetic field.

7. The apparatus of claim 1 wherein said at least one magnetic field generator comprises first and second stators adapted to produce said rotational component of said magnetic field and a third stator adapted to produce said axial component of said magnetic field.

8. The apparatus of claim 7 wherein each of said stators has an annular shape and are stacked relative to one another to define a substantially cylindrical configuration extending about said mixing vessel.

9. The apparatus of claim 7 wherein said third stator is disposed between said first and second stators.

10. The apparatus of claim 1 wherein said at least one magnetic field generator comprises first and second stators adapted to produce said axial component of said magnetic field and a third stator adapted to produce said rotational component of said magnetic field.

11. The apparatus of claim 10 wherein each of said stators has an annular shape and are stacked relative to one another to define a substantially cylindrical configuration extending about said mixing vessel.

12. The apparatus of claim 10 wherein said third stator is disposed between said first and second stators.

13. The apparatus of claim 1 further comprising:

a power source adapted to supply power to said at least one magnetic field generator at a voltage; and an electronic controller operationally connected to said power source and adapted to monitor said voltage and to correspondingly adjust said power source in response to a change in said voltage.

14. The apparatus of claim 1 further comprising:

a power source adapted to supply power to said at least one magnetic field generator; and an electronic controller operationally connected to said power source and adapted to monitor a temperature of the flowable material and to correspondingly adjust said power source in response to a change in said temperature.

15. The apparatus of claim 1 further comprising:

a power source adapted to supply power to said at least one magnetic field generator; and an electronic controller operationally connected to said power source and adapted to adjust said power source in response to a change in viscosity of the flowable material.

16. The apparatus of claim 15 wherein the flowable material is stirred at a slower rate in response to an increase in said viscosity.

17. An apparatus for magnetically stirring a flowable material, comprising:

a mixing vessel for containing a volume of the flowable material; and at least one magnetic field generator positioned adjacent said mixing vessel and adapted to produce a magnetic field acting upon the volume of flowable material to stir the volume of flowable material within said mixing vessel;

a power source adapted to supply power to said at least one magnetic field generator; and an electronic controller operationally connected to said power source and adapted to adjust said power source in response to a change in viscosity of the flowable material.

18. The apparatus of claim 17 wherein said power source has a voltage; and wherein said electronic controller is adapted to monitor said voltage and to correspondingly adjust said power source in response to a change in said voltage.

19. The apparatus of claim 17 wherein said electronic controller is adapted to monitor a temperature of the flowable material and to correspondingly adjust said power source in response to a change in said temperature.

20. The apparatus of claim 17 wherein the flowable material is stirred at a slower rate in response to an increase in said viscosity.

* * * * *